US006539594B1

(12) United States Patent
Kasai et al.

(10) Patent No.: US 6,539,594 B1
(45) Date of Patent: Apr. 1, 2003

(54) PLASTIC ZIPPER IMPROVED IN DURABILITY

(75) Inventors: Juichi Kasai, Tokyo (JP); Hiroki Imakura, Ooita-ken (JP)

(73) Assignee: Show Highpolymer Co., Ltd., Tokyo (JP)

( * ) Notice: Subject to any disclaimer, the term of this patent is extended or adjusted under 35 U.S.C. 154(b) by 0 days.

(21) Appl. No.: 09/926,059

(22) PCT Filed: Mar. 14, 2000

(86) PCT No.: PCT/JP00/01537

§ 371 (c)(1),
(2), (4) Date: Aug. 22, 2001

(87) PCT Pub. No.: WO00/54620

PCT Pub. Date: Sep. 21, 2000

(30) Foreign Application Priority Data

Mar. 15, 1999 (JP) ..... 11-068263

(51) Int. Cl.[7] ..... A44B 19/16; B65D 33/25
(52) U.S. Cl. ..... 24/585.12; 383/63
(58) Field of Search ..... 24/399, 400, 585.12, 24/DIG. 50; 383/63, 65

(56) References Cited

U.S. PATENT DOCUMENTS 3,338,284 A * 8/1967 Ausnit ..... 24/585.12 X
3,338,285 A * 8/1967 Jaster ..... 24/DIG. 50 X
3,416,585 A * 12/1968 Staller ..... 383/65
3,425,469 A * 2/1969 Ausnit ..... 24/585.12 X
3,808,649 A * 5/1974 Ausnit ..... 383/63
4,791,710 A * 12/1988 Nocek et al. ..... 24/585.12
5,012,561 A * 5/1991 Porchia et al. ..... 24/585.12
5,017,021 A * 5/1991 Simonsen et al. ..... 383/63
5,384,942 A 1/1995 Siegel

FOREIGN PATENT DOCUMENTS

| | | |
|---|---|---|
| EP | 0 446 760 | 9/1991 |
| JP | 38-7946 | 4/1963 |
| JP | 38-20939 | 10/1963 |

* cited by examiner

*Primary Examiner*—Robert J. Sandy
(74) *Attorney, Agent, or Firm*—Oblon, Spivak, McClelland, Maier & Neustadt, P.C.

(57) ABSTRACT

A plastic zipper including a male hook and a pair of female hooks that are engaged with each other to form a combination thereof. In the plastic zipper, when an opening force is applied to the plastic zipper from an opening side thereof, the pair of female hooks is provided on a flange, a portion of which, being defined by base portions of two female hooks on an opening and content side, becomes flexible. The plastic zipper is favorably used for containers for packaging, since it permits resistance to opening on the opening side to consistently hold a low value of from about 0.9 kg/5 cm to about 1.2 kg/5 cm while permitting resistance to opening on the content side to hold an enough strength of from about 7 kg/5 cm to about 8 kg/5 cm, permits the resistance to opening on both opening and content sides to remain within a specified range of resistance to opening even after opening/closing operations have been executed 100 times or more and, further, avoids a problem of a resin becoming brittle by a low temperature that would cause a problem in the engagement, and avoids an engagement function becoming inoperable after several times of opening/closing operations at an elevated temperature.

2 Claims, 3 Drawing Sheets

PLASTIC ZIPPER IMPROVED IN DURABILITY

TECHNICAL FIELD

The present invention relates to a plastic zipper having improved durability which permits easy opening, hermetical resealing after opening, and repeated opening/closing operations of more than 100 times without losing resistance to opening to be widely used in simplified containers for packaging foods, pharmaceuticals and the like, and a container with said plastic zipper.

PRIOR ART

Flexible packaging materials with plastic zippers have conventionally been used as containers for packaging various types of products by virtue of advantages thereof such as light weight, inexpensiveness, easy recyclability, high volume reduction ratio and the like and, for the reasons of advancement in hermetical sealing performance and low cost, has recently come to be used in applications for packaging products such as nutritional supplements, decolorants and the like which are frequently used but in a small quantity at a time.

However, although a conventional plastic zipper comprising a male hook and a pair of female hooks is excellent in hermetical sealing performance and resealing ability, it has problems that, when opening/closing operations exceed 30 times, a sealing function thereof is deteriorated to an unusable degree, or when it is subjected to a high temperature or a low temperature, an opening/closing function thereof is deteriorated; hence it has been desired to solve these problems.

Cross-sectional configurations as shown in FIGS. 2 to 5 have been adopted for conventional plastic zippers. In any of the configurations, a hook form on a content side is, as shown in FIGS. 2 to 5, a combination of talons of male and female hooks in an engaged state while an opening side of one or both of the male and female talons is in arc form in an engagement portion therebetween as shown in FIG. 4A or has an obtuse angle compared with talons on the content side (FIG. 4B) thereby effecting a weaker engagement strength than that of the hooks on the content side.

An engagement function of the conventional plastic zipper is explained with reference to FIG. 2.

That is, a male hook 13 is pinched by and interlocked with female hooks 14, 15 each having an increased rigidity so that, even if flanges 11, 12 which are connected to respective base portions thereof are pushed for opening in respective directions of L and L' by an opening force from the content side, the male hook 13 and the female hook 14 which are engaged and interlocked with each other in combination as shown in FIG. 4B will not be freed.

In order to maintain a state pinched (engaged) by the female hooks 14, 15 on this occasion, it is necessary to increase rigidity of the female hook as a whole whereupon the higher the above-described rigidity, the higher resistance to opening from the content side. When the above-described rigidity is weak, the female hooks 14, 15 are bent thereby freeing the thus formed interlock.

A zipper shown in FIG. 3 has the same function of opening as that in FIG. 2; however, since a thickness of a flange portion thereof is larger than that in FIG. 2, the rigidity thereof is conceivably higher than the latter one.

A gap (Y-Z) between a space Y defined by a tip B14 of the talon of the female hook 14 on the content side and a tip B15 of the talon of the female hook 15 on the opening side as shown in FIG. 2 and a thickness Z of a base portion of the male hook 13 is an important factor; there exists a tendency that the narrower the gap, the stronger the resistance to opening, while the wider the gap, the weaker the resistance to opening; therefore, it is necessary to perform an accurate control on the above-described gap whereupon difficulty in such control deteriorates a production yield causing an increase in production cost.

When an opening operation is executed from the opening side, since a female talon of the female hook 15 on the opening side has the portion in arc form as illustrated in FIG. 4A, the tip B15 of the talon of the female hook 15 move slidably along the portion in arc form of the male hook 13 as the flanges 11, 12 are opened in respective directions of O and O' whereupon the female hook 15 slightly bends to the opening side thereby enabling the engagement between the female hook 15 and the male hook 13 to be freed without necessitating a large quantity of opening force.

When the opening side of the plastic zipper is opened and, accordingly, the interlock is freed, the engagement on the content side is easily freed.

In the conventional plastic zipper, resistance to opening necessary for opening from the content side in a state in which talons are engaged with each other can be held at from about 5 kg/5 cm to about 7 kg/5 cm which are strong enough and resistance to opening necessary for opening from the opening side can be held at from about 0.6 kg/5 cm to about 1.5 kg/5 cm which are easy enough to open within 10 times of opening/closing operations; however, when opening/closing operations are repeated more than 10 times, the resistance to opening on both content and opening sides are decreased whereupon an opening/closing function can not be maintained any longer.

In the conventional plastic zipper, it has been required that the resistance to opening on the content side is strong whereas the resistance to opening on the opening side is weak. However, with reference to the zipper in the same form, when the resistance to opening on the content side becomes strong over a certain limit, that on the opening side inevitably becomes strong; to contrast, when resistance to opening on the content side becomes weak, that on the opening side inevitably becomes weak.

For this reason, an effort has hetherto been made such that, in order to increase the resistance to opening on the content side, rigidity of the female hook as a whole is increased or a size of a hook on the content side is enlarged, whereas, in order to reduce the resistance to opening on the opening side, an arc shape of the hook on the opening side is adjusted or in order to make a balance in strength between the content side and the opening side, the gap (Y-Z) between the female hook and the male hook is adjusted.

However, in the conventional plastic zipper, it is inevitable that the female hook slightly undergo a plastic deformation outward and the gap (Y-Z) between the female hooks and the male hook is gradually broadened every time an opening/closing operation is performed in a repeating way.

As a result, as a number of frequencies of opening/closing operations is increased, the resistance to opening on the opening side becomes weaker and weaker whereupon the resistance to opening is reduced by about 20 times of opening/closing operations in a type shown in FIG. 2 and by about 30 times of opening/closing operations in a type having a higher rigidity shown in FIG. 3 so that it presents a defect that the resistance to opening can not be held high enough.

Further, in the plastic zipper, the plastic deformation of the plastic material largely depends on temperatures so that there exist a problem that there are many cases in which the resistance to opening can not be held at an elevated temperature, the female hook become brittle at a low temperature and can not be bent thereby causing an engagement problem in hooks and so forth.

In the plastic zipper shown in FIG. 5, in order to increase the sense of stiffness to a finger at the time of opening/closing operations, rigidity between the female hooks 14 and 15 is increased and, further, a guide rib is provided or the male hook is separated into halves; however, the opening function thereof remains basically identical to those of the plastic zippers shown in FIGS. 2 and 3 and, even though such measures described above are taken, a problem of durability of the plastic zipper is not solved.

DISCLOSURE OF THE INVENTION

It is an object of the present invention is to develop a plastic zipper capable of adjusting resistance to opening on each of content and opening sides and permitting resistance to opening on an opening side to consistently hold a low value of from about 0.9 kg/5 cm to about 1.2 kg/5 cm while permitting resistance to opening on a content side of the zipper to hold substantial strength of from about 7 kg/5 cm to about 8 kg/5 cm and, further, capable of maintaining resistance to opening on each of the content and opening sides close to an initial one even after opening/closing operations have been executed 100 times or more.

The present invention has solved the above problems by developing:

(1) A plastic zipper comprising a male hook and a pair of female hooks that are engaged with each other to form a combination thereof, wherein the pair of female hooks is placed on a portion of flange which portion is made to flex by an opening force when applied to the plastic zipper from an opening side thereof, said portion being defined by base portions of two female hooks on the opening and content sides;

(2) A plastic zipper comprising a male hook and a pair of female hooks that are engaged with each other to form a combination thereof, wherein a base portion of the talon of the female hook on the content side is disposed to the content side over a base portion on the content side of said female hook, while the a base portion on the opening side of the female hook on the opening side is disposed to the opening side over a base portion of the talon of the female hook on the opening side;

(3) A plastic zipper comprising a male hook and a pair of female hooks that are engaged with each other to form a combination thereof, wherein a base portion on a content side of the male hook is disposed to the content side over a tip of the talon on the content side of said male hook, while a base portion on the opening side of said male hook is disposed to the content side over a tip of the talon on the opening side of said male hook;

(4) A plastic zipper which comprises in combination, the pair of female hooks set forth in at least any one of the above-described (1) and (2) and the male hook set forth in (3); and (5) A container for packaging wherein use is made of the plastic zipper set forth in any one of the above-described (1) to (4) as an opening/closing device for the container.

DESCRIPTION OF THE REFERENCE NUMERALS AND SIGNS

Figure 1:
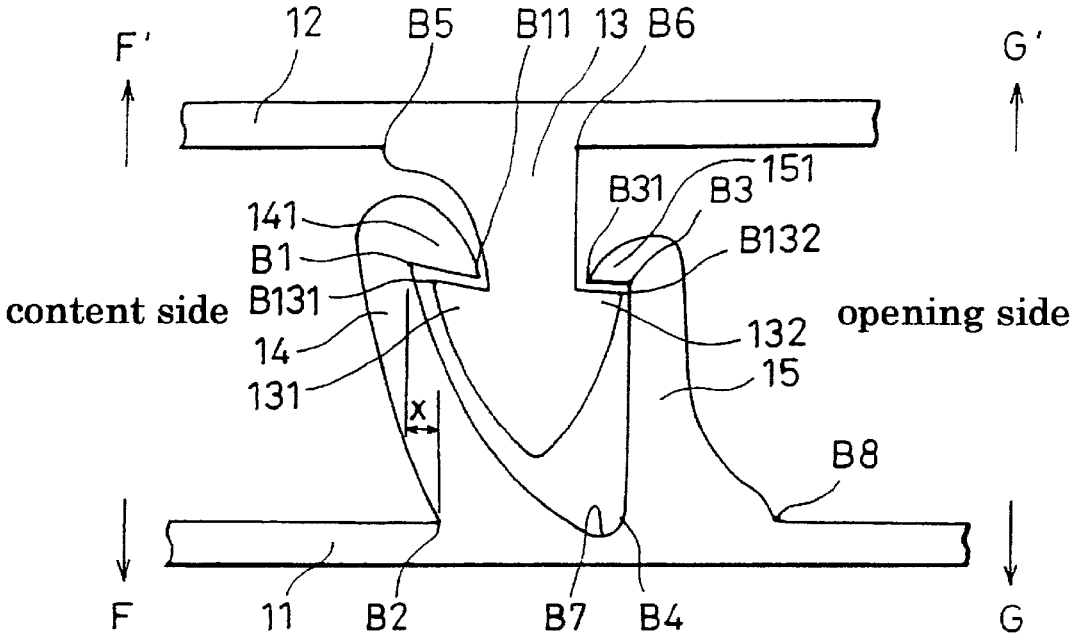
FIG. 1 is a cross-sectional view showing an engaged state of a plastic zipper according to the present invention.

11, 12: flange
13: male hook
131: talon on a content side of a male hook
132: talon on an opening side of a male hook
14: female hook on a content side
141: talon of a female hook on a content side
15: female hook on an opening side
151: talon of a female hook on an opening side
B1: base portion of a talon of a female hook on a content side
B11: tip of a talon of a female hook on a content side
B131: tip of a talon on a content side of a male hook
B132: tip of a talon on an opening side of a male hook
B2: base portion on a content side of a female hook on a content side
B3: base portion of a talon of a female hook on an opening side
B31: tip of a talon of a female hook on an opening side
B4: base portion on a content side of a female hook on an opening side
B5: base portion on a content side of a male hook
B6: base portion on an opening side of a male hook
B7: flexing point of a flange on the female hook side
B8: a base portion on the opening side of a female hook on the opening side
X: gap between perpendiculars dropped to flanges of B1 and B2
Y: gap between tips of talons of female hooks
Z: thickness of a base portion of a male hook

BEST MODE FOR CARRYING OUT THE INVENTION

A plastic zipper according to the present invention is now described with reference to the accompanying drawings.

Figure 2:
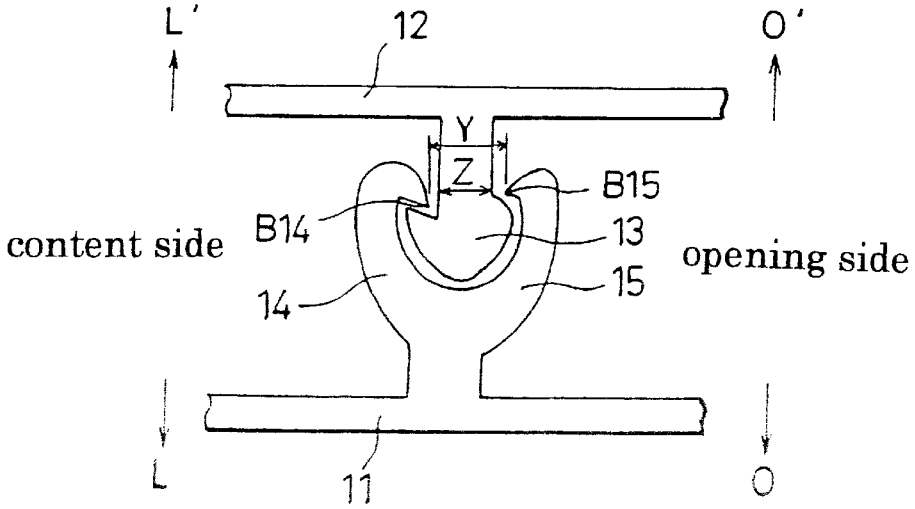
FIG. 2 is an embodiment of a cross-sectional view of a conventional plastic zipper in an engaged state.

In conventional plastic zippers illustrated in FIGS. 2 to 5, the female hook as a whole has a high rigidity; for example, in a zipper shown in FIG. 2, it has been already described that it is necessary to enhance rigidity of the female hook as a whole in order to hold a state defined by female hooks 14, 15 for the purpose of maintaining resistance to opening high.

In the conventional plastic zippers, it has been necessary that a female hook as a whole holds a high rigidity for enhancing resistance to opening; to contrast, a zipper according to the present invention, which is fundamentally different from the conventional one, is characterized in that it can hold the resistance to opening high in spite of substantially reducing the rigidity of the female hook.

That is, as shown in FIG. 1, a reduction of rigidity of a flange portion defined by base portions of the female hooks 14, 15 on the content and opening sides makes the female hooks easy to bend on this flange portion.

For this reason, the plastic zipper according to the present invention has a constitution different from that of the conventional zipper and, therefore, is a novel plastic zipper having a completely different opening/closing function.

In the plastic zipper according to the present invention, when the plastic zipper which has been engaged is freed from the opening side, an opening force for pulling a flange 11 on the female hook side and a flange 12 on the male hook side in directions shown by arrows G and G' respectively is applied.

On this occasion, if a flange on the female hook side bends at a portion defined by base portions of both female hooks 14, 15 on the content and opening sides, namely, at a flexing point B7 (permissible as long as it is easy to bend between the female hooks on the content and opening sides) between base portion B2 on a content side of a female hook on a content side and base portion B4 on a content side of a female hook on an opening side, a talon 151 of a female hook on an opening side is moved in a direction of opening to a large extent whereupon a talon 132 on an opening side of a male hook and a talon 151 are easily disengaged and, further, a quantity of movement of the talon 151 is large whereupon, because an opening force for effecting this movement in a direction of G directly acts on the flexing point B7 between base portion B2 and base portion B4, a small force can effect this movement and, moreover, a possible plastic deformation to be generated more or less on the flexing point extremely slightly affects the quantity of movement of the talon 151 so that the defect of the conventional zipper that the resistance to opening can not be held by the plastic deformation caused by about 30 times of opening/closing operations or caused by an elevated temperature does not occur in the present invention.

Further, in the present invention, since rigidity of the female hook as a whole is set low, even if the plastic material undergoes low temperature brittleness, no problem is effected in the engagement of the zipper.

Since a quantity of movement of the talon 151 is large whereby it is not necessary to shape the talon on the opening side in arc form or to render it to have an obtuse angle as in the conventional one for the time when it is disengaged from the talon 132, the two talons relate to the resistance to opening resulting in obtaining a consistent engagement.

In the case where the flexing point B7 having a low rigidity exists between base portions B2 and B4 on the flange as illustrated in FIG. 1, the female hook 14 on the content side ordinarily tends to move toward the content side whereupon the engagement tends to be freed.

In order to prevent movement of this type and hold an inside resistance to opening high, it is necessary that a gap X between perpendiculars dropped from respective points of the base portion B1 of the talon of the female hook 14 on the content side and the base portion B2 on the content side on the flange of the above-described female hook to a surface of the flange 11 (when it is a case that base portion B1 is disposed to the content side over base portion B2, the case is indicated by a plus sign while in an opposite case, indicated by a minus sign) satisfies a relational expression: $X \geqq 0$; namely, it is necessary that B1 is disposed to the content side over base portion B2.

In FIG. 1, when the resistance to opening on the content side for pulling in directions of F and F' is applied, a flange 11 on the female hook side is bent at almost right angles around the base portion B2. On this occasion, in the case of relational expression: $X \geqq 0$, the female hook 14 is not be disengaged because a torque is operated in a direction of securing the engagement of the zipper.

On the other hand, in the case of relational expression: $X<0$, the female hook 14 is subjected to a torque which operates for opening to the content side in a direction of freeing the engagement of the zipper on the content side so that the engagement tends to be freed.

If a base portion B5 on the content side of the male hook 13 engaged with the female hook 14 is disposed to the content side over a tip B131 of the talon on the content side of the male hook, when an opening force on the content side for pulling in directions of F and F' is applied on the flanges 11 and 12, since a torque is operated in a direction in which the male hook 13 closes the engagement of the zipper, the engagement with the female hook 14 is hardly freed thereby obtaining a consistent resistance to opening on the content side.

On this occasion, since resistance to breakage of the talon 141 of the female hook on a content side and the talon 131 of the male hook controls the resistance to opening on the content side, if it is desired that resistance to opening on the content side is enhanced, an optional resistance to opening can be obtained by enhancing rigidity of the talon 141 and the talon 131 partially.

When the engagement is freed from the opening side, if a base portion B8 on the opening side of the female hook 15 on the opening side is disposed to the opening side over a base portion B3 of the talon 151 of the above-described female hook, when an opening force is operated on the flange in directions of G and G', since a torque is operated in a direction in which the female hook 15 opens around the flexing point B7 as an axis, a large movement of the female hook 15 on the opening side can be obtained by a small opening force.

If a base portion B6 on the opening side of the male hook 13 engaged with the female hook 15 on the opening side is disposed to the content side over a tip B132 of a talon 132 on the opening side of the above-described male hook, when an opening force is applied to a flange in directions of G and G', since a torque is hardly operated in a direction in which the male hook 13 prevents opening, the engagement between the male hook 13 and the female hook 15 can hold a consistent easiness for disengagement.

Depending on resistance to opening on the content side, resistance to opening on the opening side, frequencies of opening and the like, a performance can be exerted even if the plastic zipper uses only one of the above-described female and male hooks and an ordinary male or female hook as a counterpart of the engagement; however, when the above-described male and female hooks according to the present invention are used in combination, even if frequencies of opening/closing operations are high, a durable plastic zipper having an optional resistance to opening on the content side and resistance to opening on the opening side can be achieved.

The present invention will now be described in more detail with reference to examples; however, the present invention is not limited thereto in any way.

EXAMPLE

A plastic zipper having a cross-sectional configuration as shown in FIG. 1 which is 1.40 mm high and 1.50 mm wide was formed of a polyethylene material.

A pair of female hooks of the above-described zipper was 1.20 mm high and 1.50 mm wide. A distance X between perpendiculars dropped from B1 (base portion of a talon of a female hook on a content side) and B2 (base portion on the content side of the female hook on the content side) to a flange was 0.15 mm; a distance between B3 (base portion of a talon of a female hook on the opening side) and B8 (base portion on the opening side of a female hook on the opening side) was 0.60 mm; a male hook was 1.10 mm high and 0.8 mm wide; a distance between B5 (base portion on the content side of the male hook) and B131 (tip of the talon on the content side of the male hook) was 0.20 mm.

The zipper having this configuration in an engaged state was cut to prepare 40 pieces of samples each having a length of 50 mm; the samples were separated into groups of 10 pieces each which were then subjected to opening/closing operations of 0, 40, 80 and 120 cycles executed from an opening side respectively; subsequently, a flange portion of each of the thus subjected samples was fixed to a tensile tester at a position 5 mm far from an end thereof; then, resistance to opening thereof in directions of G and G' was measured; thereafter, the zipper was resealed; next, the zipper was pulled in directions of F and F' to measure resistance to opening from each of the opening and content side.

The results show, as seen from Table 1, that an average resistance to opening from the content side is a consistently high value, an average resistance to opening from the opening side is a consistently low value and changes in resistance to opening and standard deviation (fluctuation) after subjected to opening/closing operations were hardly noticed; hence, it was judged that the zipper can stand 100 or more times of repeated uses.

COMPARATIVE EXAMPLE

Figure 3:
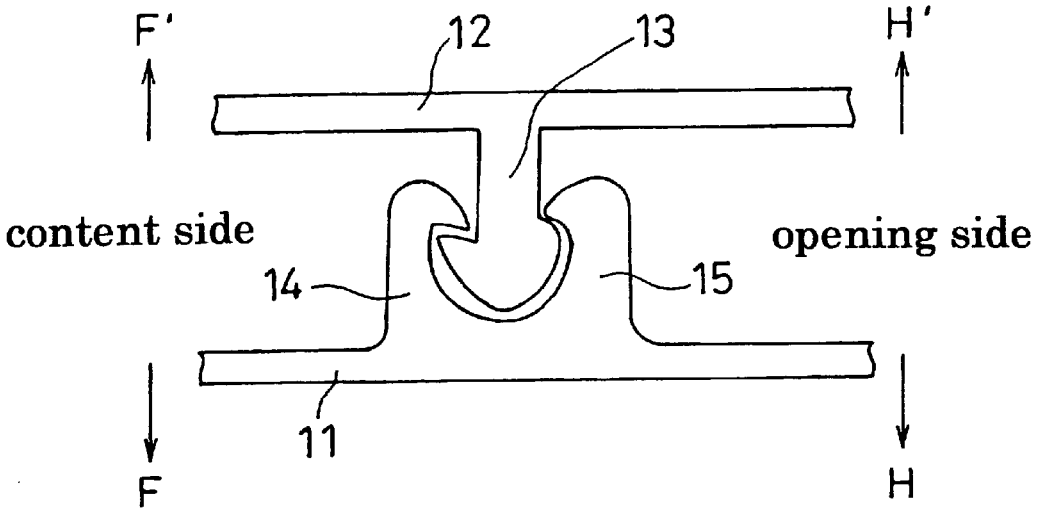
FIG. 3 is another embodiment of a cross-sectional view of a conventional plastic zipper in an engaged state.
Figure 4:
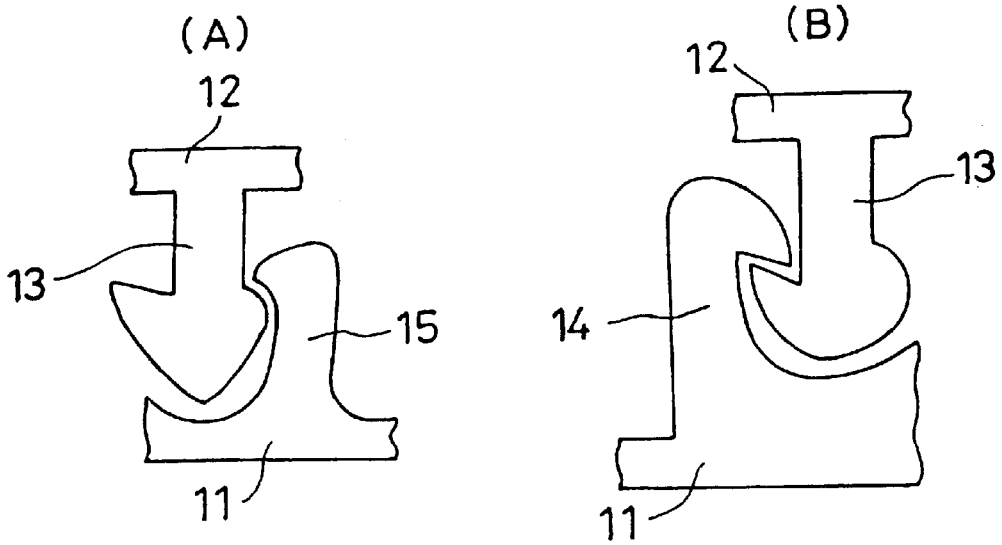
FIG. 4A is an expanded view showing an engaged state on an opening side of a conventional plastic zipper.
FIG. 4B is an expanded view showing an engaged state on a content side of a conventional plastic zipper.
Figure 5:
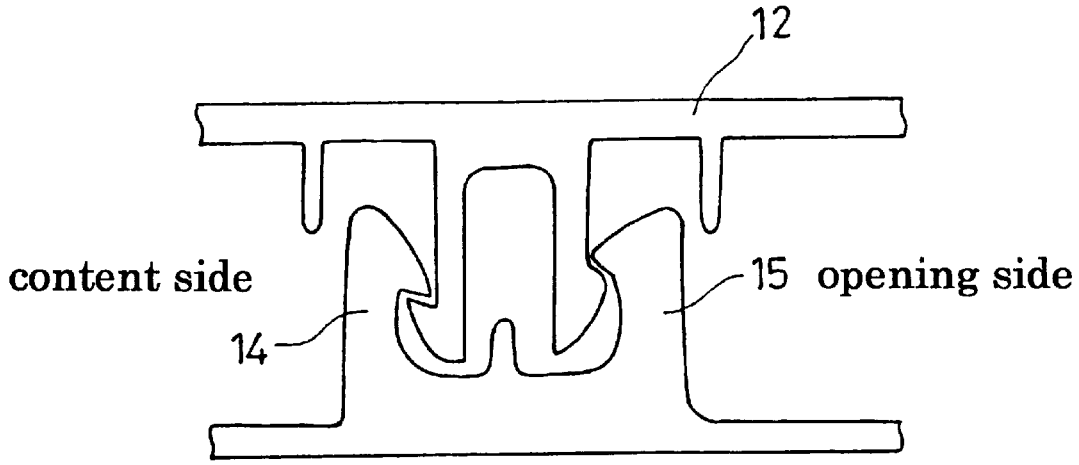
FIG. 5 is still another embodiment of a cross-section view of a conventional zipper in an engaged state.

A plastic zipper as shown in FIG. 3 which is 1.40 mm high and 1.30 mm wide in an engaged state was formed of a polyethylene material.

A pair oh female hooks of the above-described zipper was 1.30 mm high and 1.30 mm wide while a male hook was 0.90 mm high and 0.65 mm wide.

The zipper having this configuration in an engaged state was cut to prepare 40 pieces of samples; samples were then separated into groups of 10 each which were then subjected to opening/closing operations of 0, 10, 20 and 40 cycles from an opening side respectively; subsequently, a flange portion of each of the thus subjected samples was fixed to a tensile tester at a position 5 mm far from an end on the content side thereof; then, resistance to opening thereof in directions of H and H' was measured; thereafter, the zipper was resealed; next, the zipper was pulled in directions of F and F' to measure resistance to opening from each of the opening side and the content side.

The results, as seen from Table 2, show that both resistance to opening from the content side and the opening side exhibited changes more or less by 10 times of opening/closing operations; however, it was judged that there existed no problem with those samples for actual use. However, after 20 times of opening/closing operations, there were found some in which a function of the zipper has markedly been dropped. Further, after 40 times of opening/closing operations, the average resistance to opening from the opening side has dropped to about one third the initial resistance and fluctuation among measurements has markedly been increased whereupon there were found some in which a function of the zipper has been lost; hence, those samples are judged as unusable. Moreover, taking into consideration that the average resistance to opening from the content side was dropped to about one half the initial one and the fluctuation was large, it is judged that the resistance to opening is of an unusable grade.

TABLE 1

| Opening/closing (cycles) | Sample numbers (pieces) | Resistance to opening on opening side: Average value | Resistance to opening on opening side: Standard deviation | Resistance to opening on content side: Average value | Resistance to opening on content side: standard deviation |
|---|---|---|---|---|---|
| 0 | 10 | 1.07 | 0.017 | 7.85 | 0.123 |
| 40 | 10 | 1.01 | 0.021 | 7.68 | 0.167 |
| 80 | 10 | 0.98 | 0.024 | 7.65 | 0.205 |
| 120 | 10 | 0.91 | 0.030 | 7.45 | 0.221 |

(unit: Kgf/5 cm)

TABLE 2

| Opening/closing (cycles) | Sample numbers (pieces) | Resistance to opening on opening side: Average value | Resistance to opening on opening side: Standard deviation | Resistance to opening on content side: Average value | Resistance to opening on content side: standard deviation |
|---|---|---|---|---|---|
| 0 | 10 | 1.43 | 0.059 | 6.82 | 0.253 |
| 10 | 10 | 0.62 | 0.082 | 5.21 | 0.451 |
| 20 | 10 | 0.47 | 0.096 | 4.40 | 0.619 |
| 40 | 10 | 0.38 | 0.102 | 3.70 | 0.708 |

(unit: Kgf/5 cm)

INDUSTRIAL APPLICABILITY

The plastic zipper according to the present invention is favorably used for containers for packaging, since it permits resistance to opening on the opening side to consistently hold a low value of from about 0.9 kg/5 cm to about 1.2 kg/5 cm while permitting resistance to opening on the content side to hold a sufficient strength of from about 7 kg/5 cm to about 8 kg/5 cm, permits resistance to opening on each of the opening and content sides to remain within a specified range of resistance to opening even after opening/closing operations have been executed 100 or more times and, further, has solved a defect of the conventional zipper that a resin becomes brittle at a low temperature causing a problem in the engagement, or the engagement function becomes inoperable after several times of opening/closing operations at an elevated temperature.

What is claimed is:

1. A plastic zipper comprising:

a pair of flanges, a male hook connected to one of said flanges and a pair of female hooks each connected to the other of said flanges;

the male hook having a talon with a base portion on an opening side and a talon with a base portion on a content side, and being engageable with the female hooks;

each of the two female hooks having a talon with a base portion, one of the female hooks being disposed on the content side and the other of the female hooks being disposed on the opening side;

wherein a flexing point being positioned on a portion of the flange being defined by a flange base portion of each of the two female hooks which is made to flex when an opening force is applied to said plastic zipper from the opening side;

the base portion of the talon of the female hook disposed on the content side being disposed to the content side over a flange base portion on a content side of the female hook disposed on the content side and a flange base portion on the opening side of the female hook disposed on the opening side being disposed to the opening side over the base portion of the talon of the female hook disposed on the opening side;

a flange base portion on the content side of the male hook being disposed to the content side over a tip of the talon on the content side of said male hook and a flange base portion on the opening side of the male hook being disposed to the content side over a tip of the talon on the opening side of the male hook.

2. A container for packaging made of a plastic zipper as an opening/closing devise, the zipper comprising:

a pair of flanges, a male hook connected to one of said flanges and a pair of female hooks each connected to the other of said flanges;

the male hook having a talon with a base portion on an opening side and a talon with a base portion on a content side, and being engageable with the female hooks;

each of the two female hooks having a talon with a base portion, one of the female hooks being disposed on the content side and the other of the female hooks being disposed on the opening side;

wherein a flexing point being positioned on a portion of the flange being defined by a flange base portion of each of the two female hooks which is made to flex when an opening force is applied to said plastic zipper from the opening side;

the base portion of the talon of the female hook disposed on the content side being disposed to the content side over a flange base portion on a content side of the female hook disposed on the content side and a flange base portion on the opening side of the female hook disposed on the opening side being disposed to the opening side over the base portion of the talon of the female hook disposed on the opening side;

a flange base portion on the content side of the male hook being disposed to the content side over a tip of the talon on the content side of said male hook and a flange base portion on the opening side of the male hook being disposed to the content side over a tip of the talon on the opening side of the male hook.

* * * * *

UNITED STATES PATENT AND TRADEMARK OFFICE

CERTIFICATE OF CORRECTION

PATENT NO. : 6,539,594 B1
DATED : April 1, 2003
INVENTOR(S) : Kasai et al.

It is certified that error appears in the above-identified patent and that said Letters Patent is hereby corrected as shown below:

Title page,
Item [73], should read:

-- [73] Assignee: Showa Highpolymer Co., Ltd., Tokyo (JP) --

Signed and Sealed this

Tenth Day of June, 2003

JAMES E. ROGAN
*Director of the United States Patent and Trademark Office*